United States Patent [19]

Hannon

[11] Patent Number: 4,702,467

[45] **Date of Patent: * Oct. 27, 1987**

[54] MULTI-PURPOSE FEEDER FOR SUCCESSIVELY DELIVERING SINGLE SHEET OR MULTI-LEAVED ARTICLES FROM A STACK THEREOF

[75] Inventor: Charles N. Hannon, Olathe, Kans.

[73] Assignee: Stepper, Inc., Olathe, Kans.

[ * ] Notice: The portion of the term of this patent subsequent to Dec. 10, 2002 has been disclaimed.

[21] Appl. No.: 801,279

[22] Filed: Nov. 25, 1985

Related U.S. Application Data

[63] Continuation of Ser. No. 431,556, Sep. 30, 1982, Pat. No. 4,557,472.

[51] Int. Cl.[4] ..... B65H 3/02

[52] U.S. Cl. ..... 271/133; 271/19; 271/140

[58] Field of Search ..... 271/133, 134, 135, 137, 271/139, 140, 19; 101/53; 270/31

[56] References Cited

U.S. PATENT DOCUMENTS

| | | | |
|---|---|---|---|
| 1,633,937 | 6/1927 | Ford | 271/133 |
| 2,265,007 | 12/1941 | Ryan | 271/140 |
| 2,375,296 | 5/1945 | Ford | 271/138 |
| 2,541,985 | 2/1951 | Chatterton | 271/133 X |
| 2,680,614 | 6/1954 | Gibson, Jr. | 271/140 X |

*Primary Examiner*—Andres Kashnikow

*Assistant Examiner*—Matthew C. Graham

*Attorney, Agent, or Firm*—Schmidt, Johnson, Hovey & Williams

[57] ABSTRACT

The feeder has a device which reciprocates across the bottom of a stack of articles so as to separate and feed the lowermost article of the stack during each feeding stroke of the device. The device has a pair of elongated members which extend in the direction of feed and are provided with friction padding along their uppermost surfaces for making firm contact with the article to be fed. Such members, working together as an integral unit, rise up into engagement with the article to slightly raise it along the engaged portions thereof above the rest of the device as the forward stroke is commenced, thereby warping the article along the leading edge thereof as such leading edge is at the same time tucked beneath a confining element at the front of the stack which is strategically spaced above the device a distance which permits the passage of only the lowermost article during each feed stroke. This has the effect of advancing only the lowermost article from the stack into a pair of high-speed nip rollers which grab the article and immediately commence withdrawing it the rest of the way out of the stack. When the nip rollers begin pulling on the article, the raised friction members respond by dropping down to their initial position below the upper surface of the feed device, which thereupon makes its return stroke in preparation for feeding the next article of the stack.

19 Claims, 14 Drawing Figures

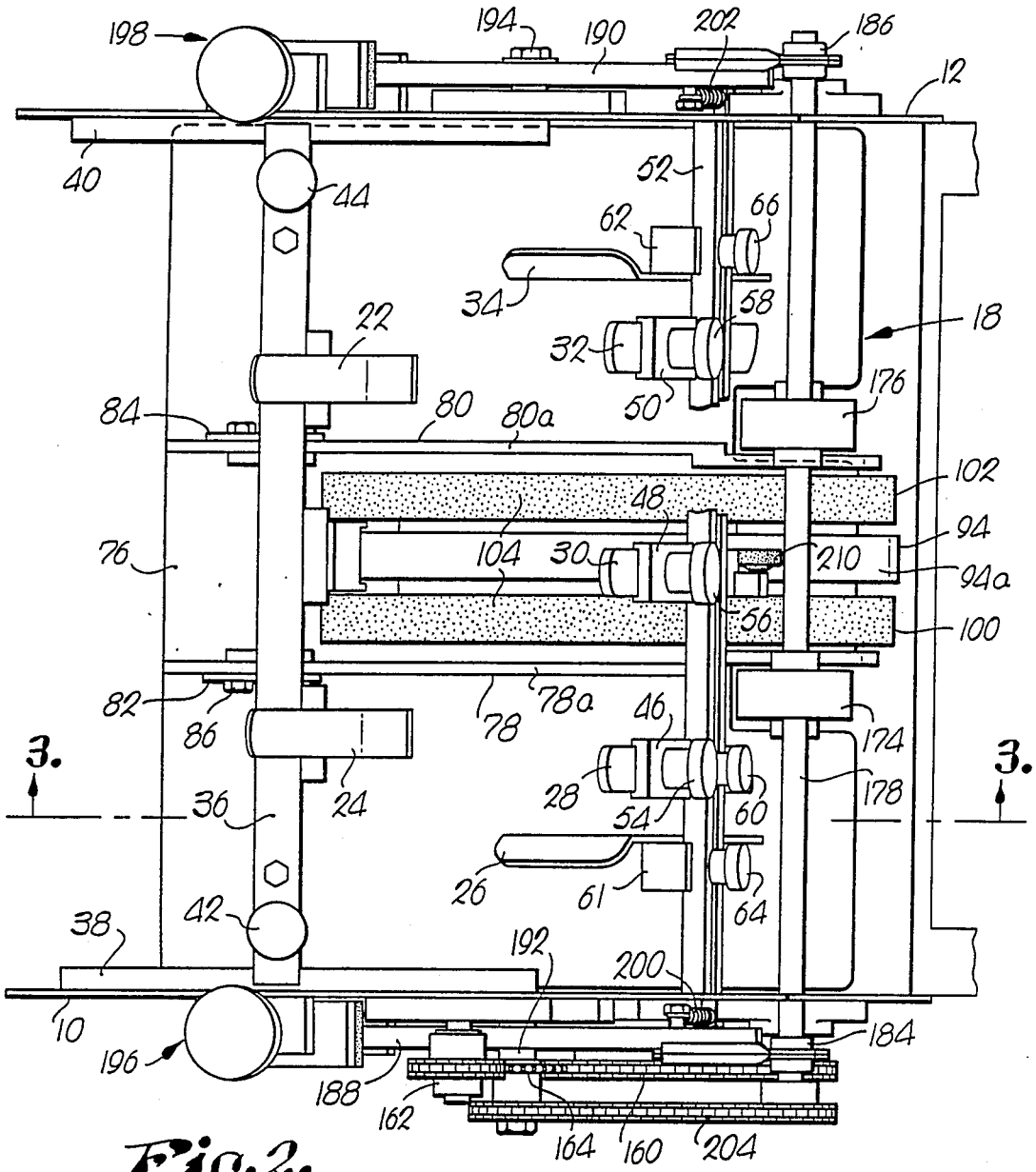
Fig. 2.
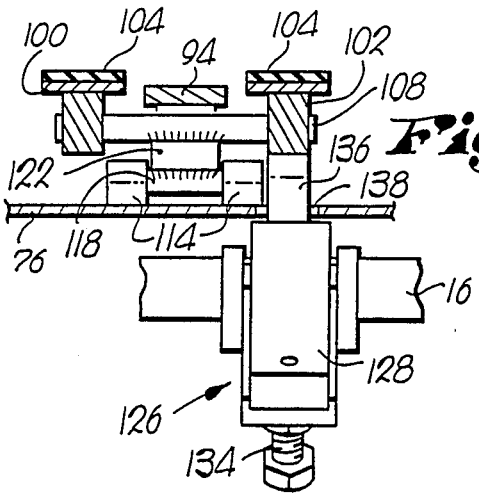
Fig. 14.
Fig. 13.
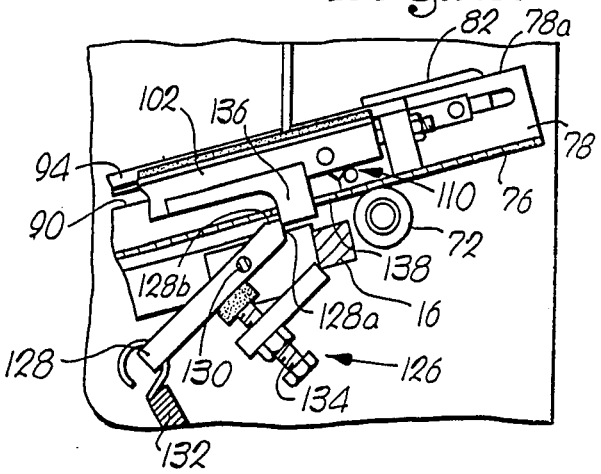

MULTI-PURPOSE FEEDER FOR SUCCESSIVELY DELIVERING SINGLE SHEET OR MULTI-LEAVED ARTICLES FROM A STACK THEREOF

This is a continuation of application Ser. No. 06/431,556, filed on Sept. 30, 1982, now U.S. Pat. No. 4,557,472.

TECHNICAL FIELD

This invention relates to the field of hopper feeders for stacks of articles such as envelopes, cards and other light gauge, single sheet articles on the one hand, and big, bulky, hundred page or more newspapers at the other extreme.

BACKGROUND ART

Hopper feeders of various kinds are presently available, but none has the degree of versatility and reliability that will permit their use as multi-purpose feeders for such widely varying types of articles as thin cards or envelopes on the one hand and bulky, voluminous newspapers on the other hand. For example, various types of bottom feed devices are available which utilize pins to impale the lowermost article in order to obtain a firm grip thereon as the feeder is moved forwardly in a feeding stroke. However, such an arrangement is not satisfactory when thin, single sheet articles are fed because the pins have a tendency to penetrate not only the lowermost article, but one or more above the lowermost article as well, thereby resulting in multiple feeds of the articles instead of the desired single or successive feeds thereof. On the other hand, in some city newspapers where the outermost jacket is simply used to receive a loose, side-by-side collection of other sections within itself, although the pins may be successful in properly engaging only the outermost article, the lack of cooperating interleaving between the outer jacket and those sections therewithin, coupled with the tremendous friction and weight of those newspapers above it in the stack, may cause a tendency for the pins to simply roll forwardly the lower half of the outer jacket while the contents of the jacket stay behind, thereby failing to feed the entire newspaper and resulting in frustrating, time consuming jam-ups of the equipment.

Vacuum separaters and feeders are likewise suitable for many situations, but, once again, they can have a tendency to adhere to only the outer half of the jacket on voluminous newspapers having loose collections of other sections therein as described above, resulting in the same type of feeding problems. Moreover, if thin, single sheet articles are attempted to be fed at the other extreme, the vacuum can "bleed through" to the next article above so that proper separation does not occur and more than one article at a time is fed.

Other types of machines utilize flat blades or the the like that are disposed on opposite sides of the lower newspaper in the stack and are slipped into the newspaper between an accessible set of pages thereof to thereupon move forwardly and pull against a fold line at the leading edge of the newspaper whereby to accomplish the appropriate feeding and separating action. While this arrangement performs well in most newspaper feeding situations, it is not suitable for single sheet articles or even multi-page articles having only a few, superimposed pages. In such latter circumstance, it is quite difficult to properly adjust the height of the blades such that they can discriminate between the leaves or pages of one article and those of the next article thereabove to the end that misfeeding can and does occur.

Certain card or envelope feeders of the type shown in U.S. Pat. Nos. 3,053,176 and 3,230,871 utilize rotary devices at the bottom of the stack having peripherally disposed friction pads or the like which wipe against and feed forwardly the lowermost envelope during each revolution of the device. This tangential type of point contact between the pads and the envelopes has not been found to be satisfactory when attempts are made to utilize this principle in connection with bulky newspapers.

Another type of envelope feeder sold under the trade designation "Postalia" by the Tele-Norm Corporation of New York utilizes a belt-type conveyor at the bottom of the stack, which conveyor has an upper stretch which is raised and lowered at certain fixed intervals while driven forwardly, thereby rising against and forwardly feeding the lowermost envelope before then returning to its retracted condition at a predetermined instant when the cam lobes associated with drive pulleys of the conveyor rotate through the next part of their revolution. While such a belt conveyor type arrangement coupled with raised pressure engagement by the belt on the lowermost article provides an effective separation means for envelopes and single sheet articles, it would not be satisfactory in connection with the handling and feeding of bulky newspapers because, among other things, such a preset raising and retraction cycle would not account for the significant slippage which is commonplace when friction feeders are utilized to feed bulky newspapers and the upper papers in the stack weigh heavily upon the lower paper so as to exert a sizeable retaining force that must be overcome if proper feeding is to be achieved.

Consequently, there has simply not heretofore been a feeder having that versatility and flexibility that will permit the same machine to be utilized with equal success for both single sheet feeding as in cards and envelopes, and multiple sheet feeding as in bulky, big city newspapers.

SUMMARY OF THE INVENTION

Pursuant to the foregoing, an important object of the present invention is to meet the long felt need for a hopper feeder that is versatile enough to successfully feed all kinds of sheet articles regardless of their size, thickness, porosity and number of pages whereby the ultimate user can enjoy the benefits and economies of cost, time, and labor flowing from such multi-purpose hopper.

In achieving the foregoing objective, the hopper feeder of the present invention utilizes a special, bottom feed, reciprocating support device that employs a pair of laterally spaced apart friction members which rise up into engagement with the lowermost article as the support commences its forward feed stroke. Such members actually raise the lowermost article above the rest of the support in the area of contact with the members as the forward movement commences, this having a tendency to warp the leading edge of the article out of its normal, flat plane as such leading edge becomes tucked beneath a confining or restricting element at the front edge of the hopper. Consequently, the lowermost article becomes separated from the article next above it in the stack such that as the feed stroke continues, only the lowermost article moves forwardly while the others are confined by the hopper structure, and, particularly by the forward containing element. As the leading edge of the lowermost article is presented to a pair of high-speed nip rollers, such rollers grab the article and pull it the rest of the way out of the stack. As such pulling action is commenced, the friction members respond to that action by immediately dropping back to their retracted position below the upper surface of the remainder of the support, whereupon the support device completes the last half of its reciprocating cycle by returning to its place of origin for commencement of the next feed stroke. A pair of laterally spaced rails support the stack with their upper edges rather than through a broad, flat surface over the entire area of the lower article, whereby to promote a draping action on the part of the articles as they hang over the sides of the rails, this tending to induce increased, column-like rigidity to the articles if they are floppy in nature such as is often the case with newspaper articles. This increased structural strength enables the newspapers to be assisted in their feed stroke by rearwardly located pushing structure that engages the trailing edge of each lower article to push the same forwardly as the friction members operate on the lowermost face thereof during the feed stroke.

BRIEF DESCRIPTION OF THE DRAWINGS

FIG. 2 is a top plan view thereof taken substantially along line 2—2 of FIG. 1;

FIG. 13 is an enlarged, fragmentary, detailed view, partly in cross-section and partly in elevation, of mechanism associated with the separating and lifting friction members of the feeder; and FIG. 14 is an enlarged, fragmentary, rear detailed view of the friction members and associated operating mechanism.

DETAILED DESCRIPTION

Figure 1:
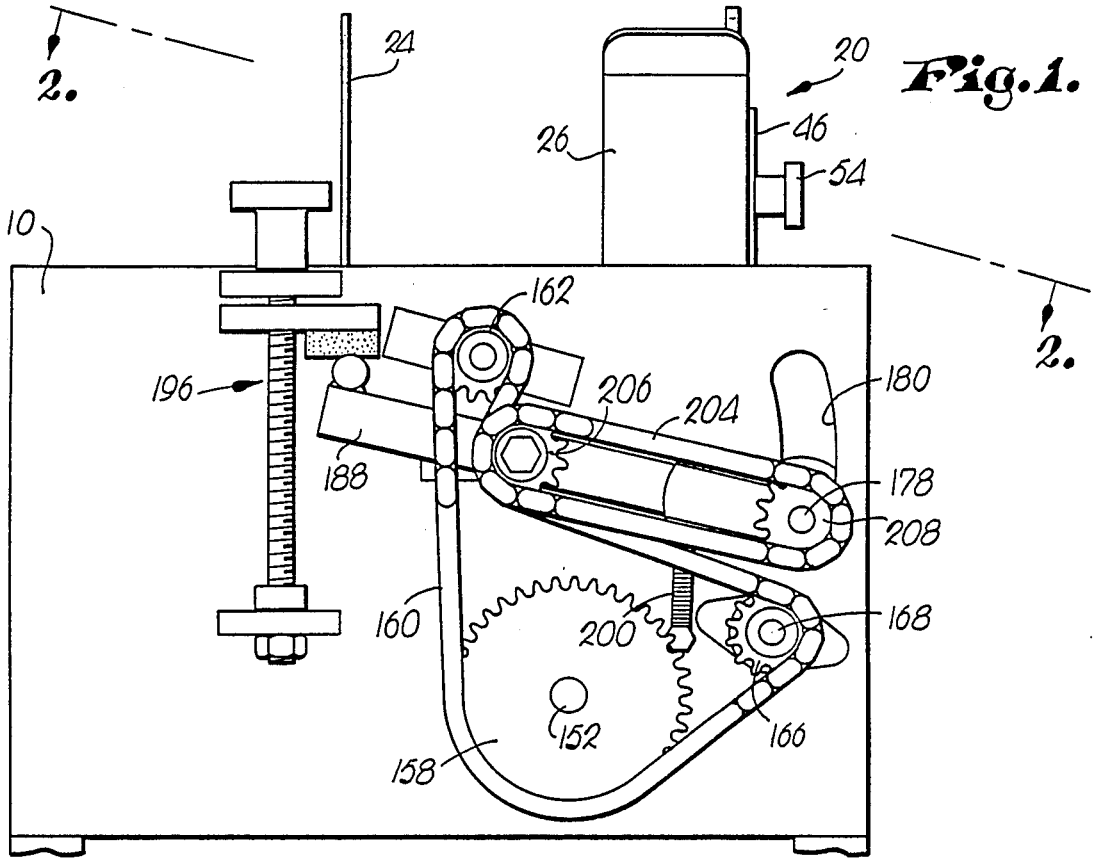
FIG. 1 is a side elevational view of a feeder constructed in accordance with the principles of the present invention.

The feeding hopper of the present invention includes a pair of upright side plates 10 and 12 which are structurally interconnected by a pair of transverse bars 14 and 16 situated below a reciprocating feeder device 18 located between the two side plates 10 and 12. A hopper 20 is defined between the plates 10 and above the device 18 by a series of variously adjustable, upright retainers 22, 24, 26, 28, 30, 32 and 34, all of which are shown in FIG. 2. The rear retainers 22, 24 are attached to a transverse bar 36 which is slidably carried at its opposite ends by a pair of forwardly and downwardly inclined guides 38 and 40 on the side plates 10 and 12 respectively. Setscrews 42 and 44 operably associated with the guides 38 and 40 respectively permit the bar 36 to be releasably held in any one of a number of selected positions along the lengths of the inclined guides 38, 40 so as to determine the dimension of the hopper 20 in a fore-and-aft direction and permit adjustment thereof to accomodate the particular articles being fed.

Figure 3:
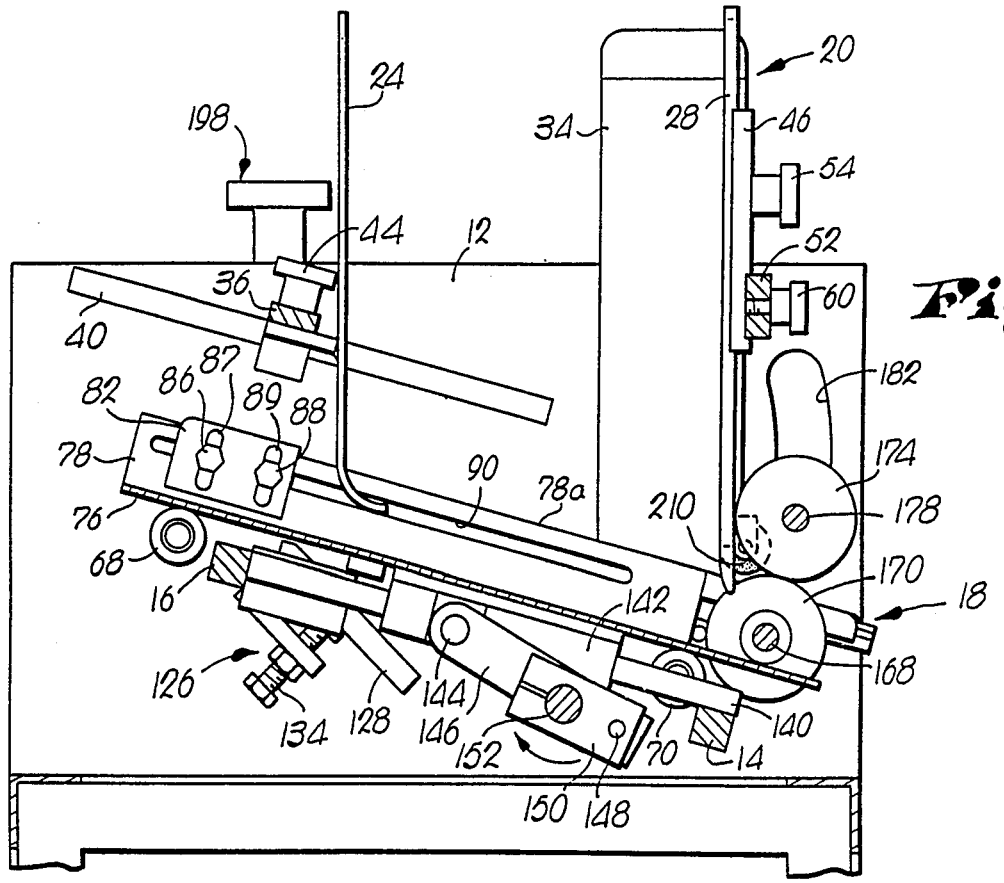
FIG. 3 is a vertical, cross-sectional view thereof taken substantially along line 3—3 of FIG. 2.

The retainers 28, 30 and 32 at the front of the hopper 20 are vertically, slidably carried by respective brackets 46, 48 and 50 which, in turn, are slidably carried upon a transverse bar 52 spanning the two side plates 10. Setscrews 54, 56 and 58 associated with the corresponding brackets 46, 48 and 50 releasably hold the corresponding front retainers 28, 30 and 32 in selected vertical positions of adjustment. Likewise, setscrews 60 for the brackets 46, 48 and 50 (only one being shown) hold such brackets in selected longitudinal positions along the bar 52, further details of construction of this relationship being illustrated, for example, in FIGS. 3, 4 and 12.

The remaining retainers 26 and 34 serve as the lateral confining means for the articles contained within the upright loading zone defined by the hopper 20. Such retainers 26 and 34 are carried by corresponding brackets 60 and 62 which are held in selected positions of adjustment along the bar 52 by setscrews 64 and 66 respectively.

The feeder device 18 is supported for its fore-and-aft reciprocating movement by a set of four rollers 68, 70, 72 and 74 (roller 72 is shown in FIG. 13) located essentially at the four corners of the device 18 and disposed to provide a downwardly and forwardly inclined attitude for the device 18 corresponding to that attitude presented by the guides 38, 40 for the rear retainers 22, 24 of the hopper 20. A support plate 76 of the device 18 rides on top of the rollers 68–74 and provides a mounting surface for numerous structures which function to engage and feed the articles during operation. To this end, a pair of relatively thin, upstanding rails 78 and 80 are affixed to the support plate 76 with their longitudinal axes extending in the direction of feed and located in spaced apart relationship on opposite sides of a fore-and-aft centerline of the machine. The rails 78 extend the full fore-and-aft length of the support plate 76 and present uppermost, article supporting edges **78*a* and 80*a*. A pair of pushers 82 and 84 are associated with respective ones of the rails 78, 80 and are located generally adjacent the rear ends thereof. The pushers 82, 84 are in the form of relatively small, rectangular plates affixed to the outer faces of the respective rails 78, 80 by releasable fasteners 86 and 88 (see FIG. 3) which project through corresponding, elongated slots 90 and 92 in the rails 78 and 80. The slots 90 and 92 extend in fore-and-aft directions in parallel relationship to the plate 76 whereby to enable the pushers 80 and 82 to be adjusted fore and aft of the rails 78, 80 upon loosening of the fasteners 86, 88 thereof. Such loosening of the fasteners 86, 88 also permits the pushers 82 and 84 to be adjustably positioned vertically due to slots 94 and 96 in the pushers through which the fasteners 86, 88** pass.

The plate 76 also carries a center, fore-and-aft extending bar 94 supported above the top surface of the plate 76 by upstanding posts 96 and 98 (FIG. 7) at such a height that the top surface of the bar 94 coincides with the level of the upper edges **78*a* and 80*a* of rails 78, 80**.

Also supported by the plate 76 and forming a part of the feeder device 18 is a pair of separating and feeding members 100 and 102 which are elongated in the direction of the feeding motion and are situated on opposite lateral sides of the bar 94 yet between the two rails 78 and 80. Each of the members 100, 102 is provided with a rubberized cap or pad 104 as shown in FIG. 2 for increasing the coefficient of friction thereof and thereby promoting proper feeding engagement of the members 100 and 102 with the articles throughout the feeding operation as will be subsequently explained. The two feed members 100, 102 are tied together structurally whereby to function as a unit during operation by a pair of cross pins 106 and 108 (FIGS. 7, 9 and 14) in front of the posts 98 and 96 respectively, such cross pins 106 and 108 forming upper pivot points of a four-bar linkage broadly denoted by the numeral 110 that serves to pivotally attach the members 100, 102 to the plate 76. Mounts 112 and 114 on the upper face of the plate 76 are disposed at the front and rear of the latter respectively and carry additional, respective cross pivots 116 and 118 which form the lower points of the four-bar linkage 110. Parallel links 120 and 122 connect the cross pivot 116 with the cross pin 106 and the cross pivot 118 with the cross pin 108 respectively whereby to complete the four-bar, parallel linkage 110. Thus, the members 100, 102 can swing as a unit between a lowered, retracted position as shown, for example, in FIG. 4 and a raised, extended position, as shown, for example, in FIG. 7, there being an adjustable stop 124 provided in association with the rear link 122 for limiting the swinging of the members 100, 102 to their raised position. It is to be noted that, as perhaps shown best in FIG. 14, the friction pads 104 of the members 100, 102 are disposed slightly above the upper face 94*a* of the bar 94 when the members 100, 102 are in their fully raised position, and, likewise, the friction pads 104 of members 100, 102 are situated slightly above the uppermost edges 78*a* and 80*a* of rails 78 and 80 when the members 100, 102 are in their fully raised position (see for example FIG. 10). At the other extreme, the friction pads 104 of the members 100, 102 are disposed at or below the upper face 94*a* of bar 94 and the upper edges 78*a* and 80*a* of rails 78 and 80 when the members 100, 102 are in their lowered position.

As illustrated particuarly in FIG. 13, there is mechanism provided beneath the plate 76 for shifting the members 100, 102 to their raised position as the plate 76 commences each feed stroke. In this respect, such mechanism, broadly denoted by the numeral 126, includes a cam lever 128 having a transverse pivot 130 located between the opposite ends of the lever 128 and held at a fixed position by suitable attachment to immobile, structural components of the feeder such as the rear crossbar 16. The cam lever 128 is yieldably biased in a counterclockwise direction viewing FIG. 13 by a tension spring 132 connected at one end to the lower extremity 128 and at its other end to suitable immobile structure of the hopper feeder. Such counterclockwise biasing movement of the lever 128 about its pivot 130 is limited by an adjustable stop 134 which is so positioned as to present the upper end of the cam lever 128 into the path of travel of a depending projection 136 on the member 102, such projection 136 passing through a clearance slot 138 in the plate 76. The upper end of the cam lever 128 has a pair of converging, beveled surfaces 128*a* and 128*b* which bear against the projection 136 at different times in the operation of the machine as will hereinafter be made clear.

The plate 76 is guided in its reciprocation by a fore-and-aft extending, centrally disposed guide rod 140 supported between the two cross bars 14 and 16. A sleeve 142 fixed to the bottom of the plate 76 is slidably received on the guide rod 140 and is connected through a pivot 144 to a link 146 forming a part of the drive mechanism for the plate 76 and hence also the feeder device 18 as a whole. The link 146 is connected at its opposite end by a pivot 148 to a crank 150 clamped onto an input drive shaft 152 carrying a sprocket 154 (FIG. 9) which is entrained by a drive chain 156 leading to a source of power (not shown).

Figure 11:
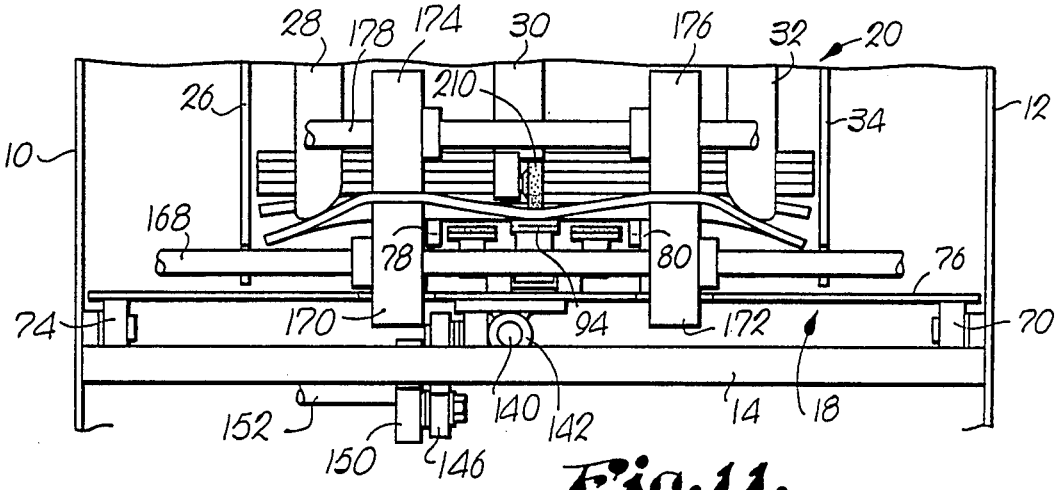

The input drive shaft 152 projects outwardly through and beyond the side plate 10 and on its outermost end carries a large sprocket 158 (FIG. 1) which delivers power from the shaft 152 to an endless chain 160 partially entrained around the sprocket 158. The chain 160 is also entrained about an upward idler sprocket 162, is back-wrapped around an intermediate idler sprocket 164 (FIG. 2) and is then trained around a driven sprocket 166 adjacent the front of the feeder which is carried by a shaft 168 (FIGS. 1 and 11) which spans the side plates 10, 12, and is journaled thereby. Shaft 168 carries a pair of lower nip rollers 170 and 172 which are located in spaced relationship along the shaft 168, each just slightly outboard of the corresponding rails 78 and 80.

The lower nip rollers 170 and 172 have their upper peripheries positioned a short distance above the inclined plane of the upper edges 78*a* and 80*a* of the rails 78, 80 and are designed to cooperate with an opposed pair of upper nip rollers 174 and 176 carried on and driven by a cross shaft 178 parallel to the shaft 168, spanning the end plates 10, 12, and projecting outwardly therebeyond through respective, vertical, slightly arcuate slots 180 and 182 (see FIG. 1 for the slot 180). Viewing FIG. 2 it may be seen that the cross shaft 178 is supported by bearings 184 and 186 at opposite ends thereof which are, in turn, carried by the outer or forward ends of respective arms 188 and 190, each having a pivot point intermediate the opposite fore-and-aft ends thereof. In the case of the arms 188, the intermediate pivot point thereof is defined by a stub shaft 192 which also defines the axis of rotation of the intermediate idler sprocket 164 shown at FIG. 2, while in the case of the arm 190, the intermediate pivot point is defined by a suitable bolt 194 also shown in FIG. 2. The rear ends of the arms 188 and 190 are operably engaged by respective adjustment assemblies 196 and 198 which may be manipulated in order to swing the arms 188, 190 about their pivots 192, 194 to correspondingly adjust the spacing between the upper nip rollers 174, 176 and their cooperating lower nip rollers 170, 172. A tension spring 200 coupled with the arm 188 yieldably biases the latter downwardly while a corresponding tension spring 202 (FIG. 2) correspondingly biases the arm 190 in a downward direction.

Power to the upper nip rollers 174 and 176 is supplied through an endless chain 204 (FIGS. 1 and 2) trained about a first sprocket 206 which shares the same axis of rotation as the idler 164 and is driven thereby, and a second sprocket 208 which is fixedly connected to the outermost end of the shaft 178 of nip rollers 174, 176. Consequently, the upper nip rollers 174, 176 are driven in a counterclockwise direction viewing FIG. 3, for example, while the lower nip rollers 170 and 172 are driven in a clockwise direction viewing that same figure, both sets of rollers being driven at relatively high speeds.

The centrally disposed retainer 30 has a small, non-rotatable, circular, rough-surfaced component 210 located at its lowermost end for promoting separation of the lowermost article from those thereabove during each feed stroke of the feeder device 18. By releasing the setscrew 56, the vertical position of the component 210, and thus also its lower, arcuate periphery, may be adjusted by sliding the retainer 30 through the bracket 48 in the necessary direction.

Operation

Broadly speaking, the feed device 18 reciprocates across the bottom of the hopper 20 and during each forward feed stroke separates the lowermost article in a stack from those thereabove and presents the same to the high-speed nip rollers 174, 176 and 170, 172 which complete withdrawal of the article from the stack. Various adjustments of the hopper confines and the nip roller positioning may be made according to the characteristics of the particular articles being fed, utilizing the various structures above described for this purpose.

Figure 12:
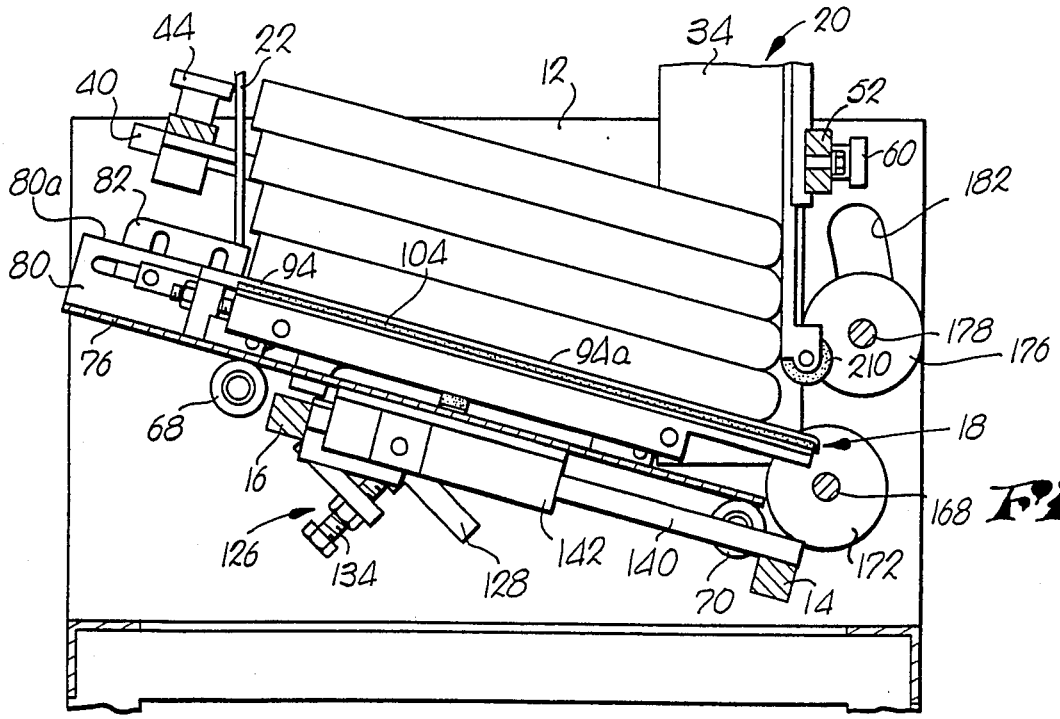
FIG. 12 is a fragmentary, vertical, cross-sectional view through the hopper similar to FIG. 4, but showing the apparatus arranged for the feeding of even bulkier articles such as big city newspapers.

For the sake of example only, the hopper 20 has been illustrated in FIGS. 4–11 as set up to receive and feed a stack of newspapers or the like which are not excessively thick or bulky, although it is to be appreciated that hopper 20 could just as readily be prepared to handle single sheet cards, envelopes or the like, or even considerably bulkier, big city newspapers such as that illustrated in FIG. 12. In any event, considering the nature of the newspaper stack illustrated in FIGS. 7–11, the nip rollers 174, 176 and 170, 172 are positioned for peripheral contacting engagement as illustrated, and the rough-surfaced component 210 is spaced a distance above the bar 194 corresponding to the thickness of only one of such newspapers, the lowermost newspaper in the stack being denoted by the reference numeral 212 throughout the description which follows. Although the newspaper 212 and those above it in the stack are illustrated in the drawings as lying flatly within the hopper 20, it has in some instances been found desirable to so adjust the rear retainers 22 and 24 that the hopper 20 is actually shallower in a fore-and-aft dimension than the newspapers such that the rear ends thereof are forced to curl upwardly when placed within the hopper 20.

Figure 4:
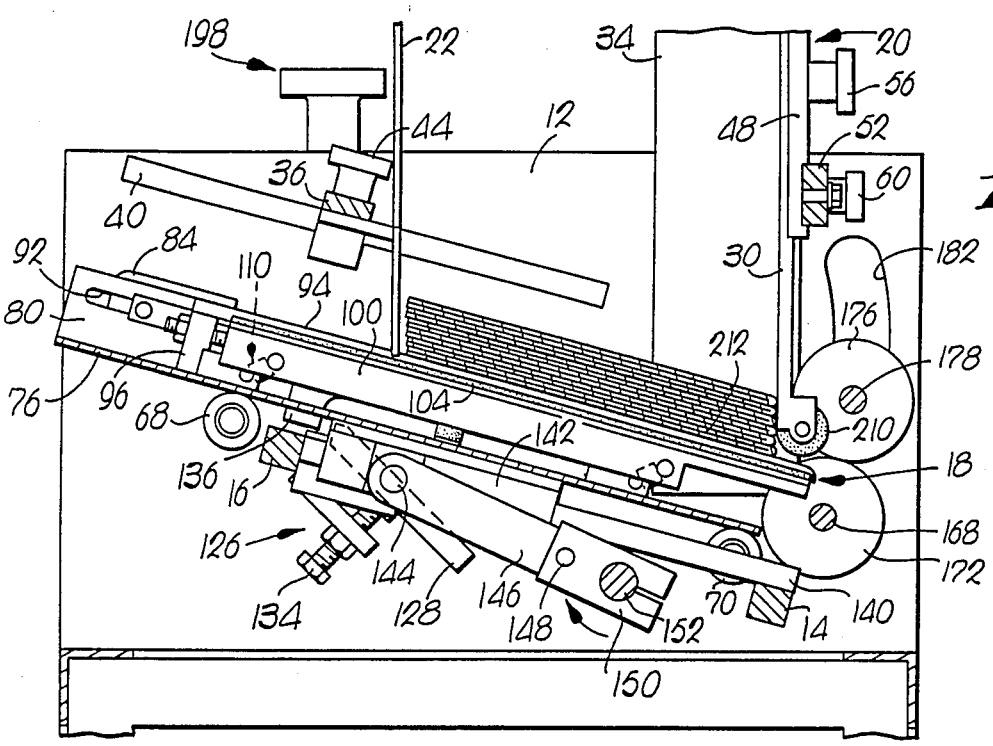
FIGS. 4, 5, 6, 7 and 8 are fragmentary, vertical, cross-sectional views of the hopper taken substantially along a fore-and-aft midline of the latter and illustrating certain respective, sequential, operational steps of the hopper during the feeding of each lowermost article contained therein.
Figure 9:
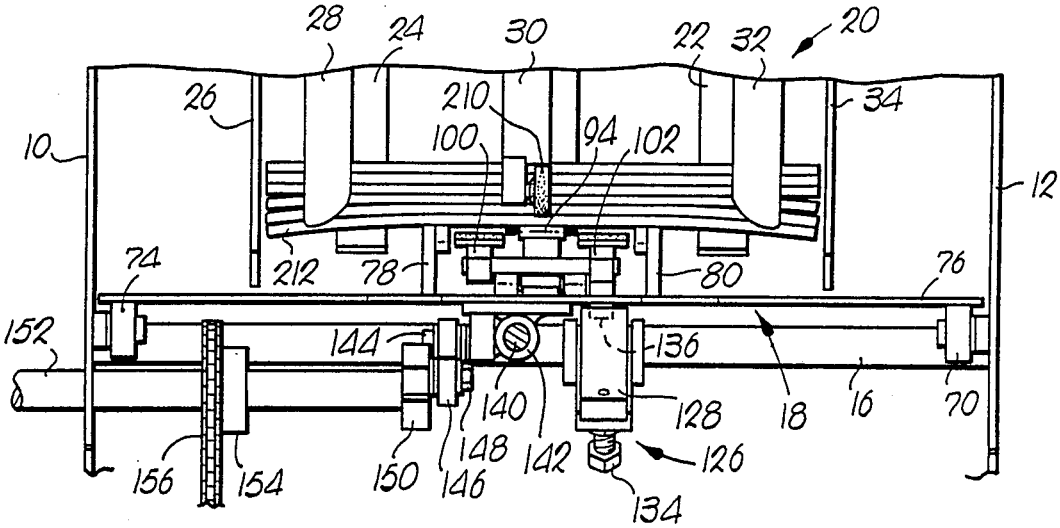
FIGS. 9, 10 and 11 are fragmentary, front elevational views of the hopper showing the condition of things from that vantage point corresponding to FIGS. 4, 7 and 8 respectively.

FIGS. 4 and 9 illustrate the condition of things at the commencement of a feeding cycle and just prior to a feed stroke of the device 18. At this time, the friction members 100,102 are in their retracted position with the pads 104 thereof disposed slightly below the upper edges **78*a* and 80*a* of the rails 78 and 80, as well as slightly below the upper surface of the bar 194. Consequently, the lowermost newspaper 212 is supported from beneath entirely by rails 78, 80 and bar 94** at this point in time.

Figure 5:
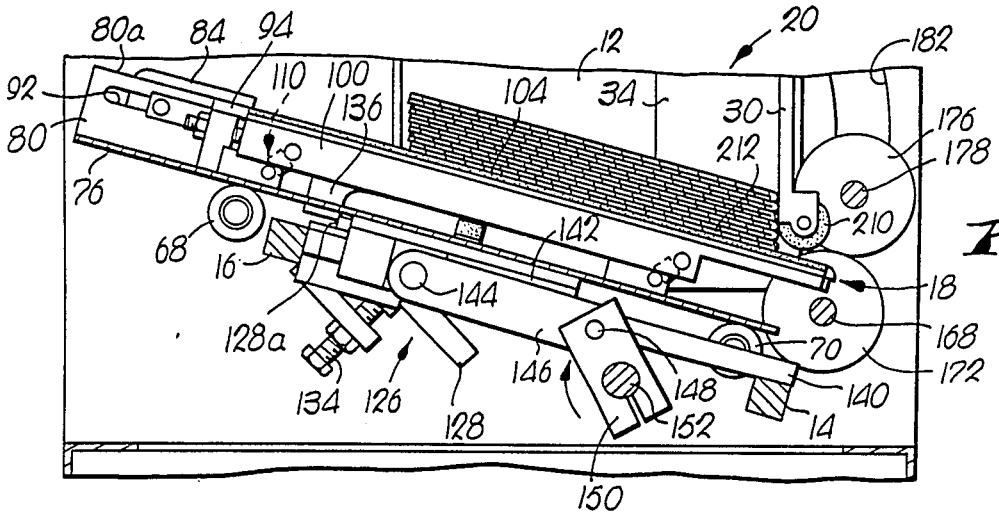
Figure 6:
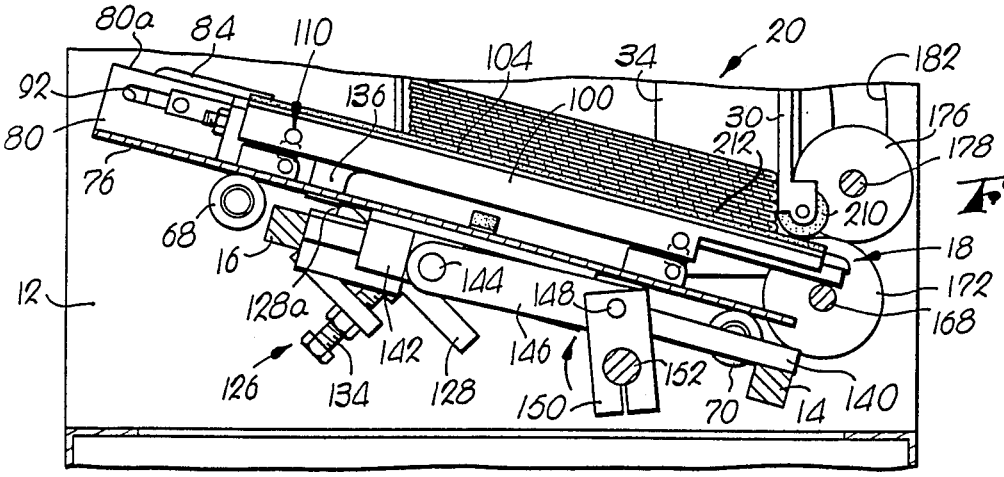

As the feeder device 18 starts forwardly in its feed stroke as illustrated in FIG. 5, the forward face of the projection 136 comes into engagement with the rearwardly facing cam bevel **128*a* of cam lever 128. Consequently, the members 100, 102 are cammed upwardly in a swinging motion through their four-bar linkage 110 as the forward movement of plate 76 is continued as shown in FIG. 6. Such raising of the members 100, 102 relative to the forwardly moving plate 76 continues until such time as the projection 136 clears the surface 128*a* of cam lever 128, by which time the pads 104 of the members 100, 102 will have risen above the rail edges 78*a*, 80*a* and the top surface 94*a* of bar 94, thus pressing the pads 104 against the under surface of the lowermost newspaper 212**.

This lifting pressure exerted by the members 100, 102 upon the lowermost newspaper 212, coupled with the fact that the members 100, 102 are moving forwardly with the plate 76 at that time, has the effect of simultaneously forcing the leading edge of the newspaper 212 beneath the component 210 and buckling or warping at least such leading edge out of its normal, flat plane. This conjoint action helps break away the lower newspaper 212 from the frictional retaining force of the next paper thereabove, and, since the component 210 is so low that only the lowermost paper 212 can pass between it and the bar 194, only the lower paper 212 is fed forwardly at this time. This sequence of events and condition of things is illustrated by corresponding FIGS. 7 and 10.

Figure 7:
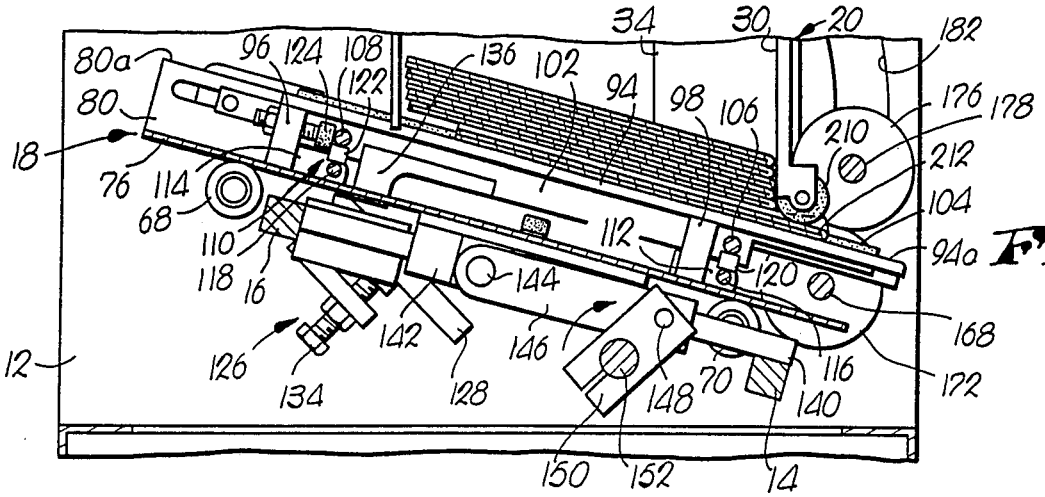
Figure 8:
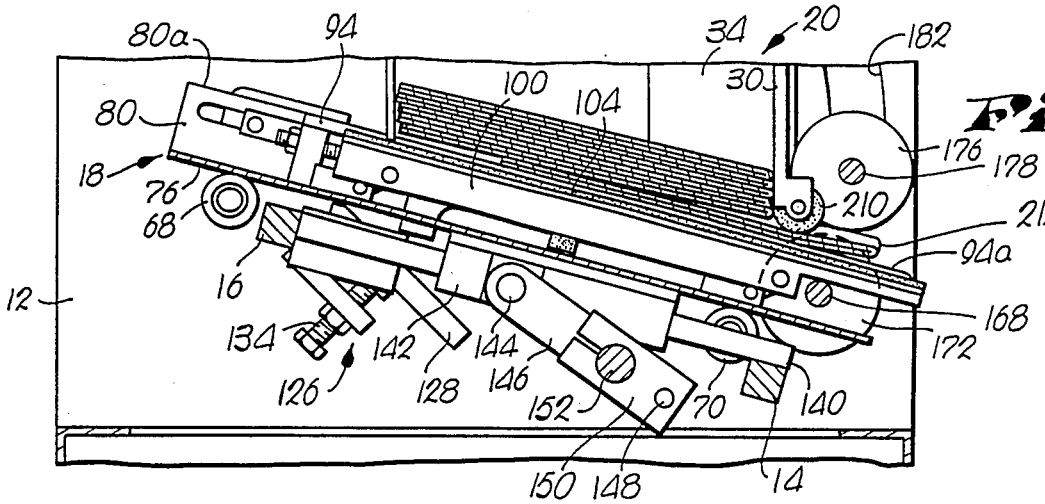
Figure 10:
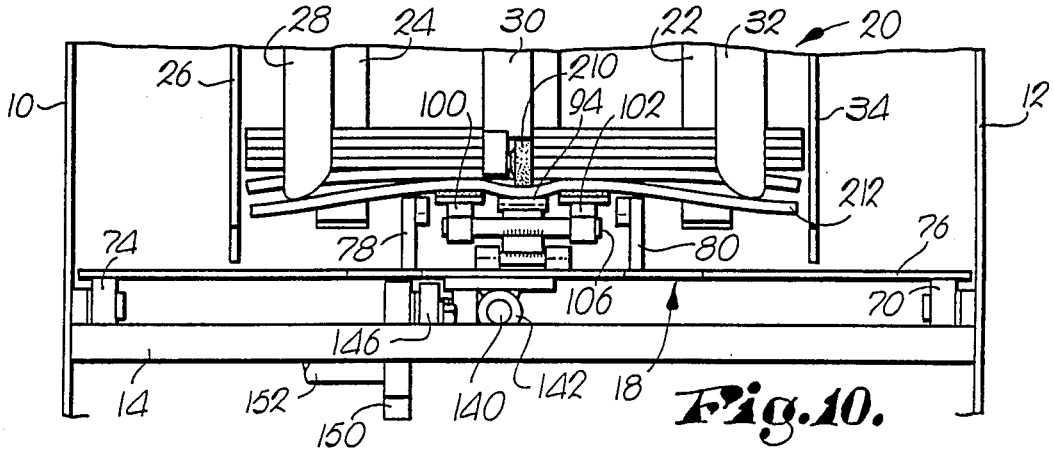

It is important to note that by the time the members 100, 102 reach their fully raised position of FIGS. 7 and 10 and their slightly forwardly advanced locations, there is no stop, projection or other mechanical structure physically holding the members 100, 102 in their raised position. Due to the geometry of the four-bar linkage 110 when the members 100, 102 are fully raised, the weight of the stack of articles thereon, and the rearwardly directed reaction force on the members 100, 102 tending to move them upwardly and rearwardly as the plate 76 is driven forwardly, the members 100, 102 remain raised. However, as soon as the leading edge of the newspaper 212 is inserted between and gripped by the nip rollers 174, 176 and 170, 172 so as to begin exerting a pulling force on the newspaper 212, the forces which have heretofore cooperated to maintain the members 100, 102 fully raised are instantly overcome and the members 100, 102 drop down toward their retracted position as illustrated by corresponding FIGS. 8 and 11. Thus, at that instant, the lower newspaper 212, as well as the exposed rearward portion of the next newspaper thereabove, becomes once again supported totally by the rails 78, 80 and the bar 94 whereby to facilitate sliding withdrawal of the newspaper 212 the rest of the way out of the stack by the nip rollers 174, 176 and 170, 172. Therefore, there is very little, if any, frictional drag exerted by the members 100, 102 on the newspaper 212 as it is pulled out of the stack by the nip rollers 174, 176 and 170, 172.

With the members 100, 102 thus fully lowered, the feeder device 18 reaches the forward limit of its feed stroke and thereupon returns rearwardly in preparation for the next feed stroke. As the plate 76 travels rearward toward such position, the projection 136 drags across the lever 128 and its beveled surface **128*b* whereby to momentarily swing the latter downwardly until the plate 76 reaches its fully rearward disposition at which time the projection 136 will have cleared the lever 128 and come to rest behind the same as shown in FIG. 13**.

It is important to note that retraction of the members 100, 102 from their fully raised position is responsive to and conditioned upon the commencement of pulling force by the nip rollers 174, 176 and 170, 172 on the leading edge of the article being fed. It is not mechanically tied into the drive for the plate 76 or otherwise preset to take place at a certain, established point during each feed stroke.

Consequently, retraction of the members 100, 102 is customized to the conditions which exist during each individual feed stroke, e.g., the frictional force developed between the members 100, 102 and the particular article in the stack then being fed (whether the first article in the stack with considerable weight thereabove, or the last article with little weight thereabove), the slickness of different types of the articles, and the dimensions of the articles. In other words, the mounting arrangement for the members 100, 102 accomodates the fact that a certain amount of initial slippage may occur between feed members 100, 102 and the lowermost article being fed, and such slippage may occur in varying amounts from article to article in the stack and from one article to the next as different types and sizes of articles are selected for feeding. Thus, different articles may technically reach the nip rollers 174, 176 and 170, 172 at different times relative to the position of the device 18 in its feed stroke but such irregularity is in no way detrimental to the smooth, reliable operation of the machine because the friction members 100, 102 never release their contact with the lowermost article until it has actually been received and gripped by the nip rollers 174, 176 and 170, 172. Thus, the members 100, 102 never stay up too long such as to accidentally engage the exposed rear end of the next article in the stack and commence feeding it forwardly along with the bottommost article, nor do they retract too soon before the bottommost article has been fully gripped by the nip rollers 174, 176 and 170, 172.

If desired, the auxillary pushers 82 and 84 may be utilized, although such will not normally be necessary unless the articles being dispensed are fairly bulky, such as the big city newspapers illustrated in FIG. 12. At that time, the pushers 82 and 84 may be adjusted upwardly and forwardly into appropriate positions where they are disposed to bear against the rearward edges of the newspapers, but only such edges of the lowermost newspaper in the stack.

During the use of such auxillary pushing force, the value of the spaced, thin edge support provided by the rails 78 and 80 becomes especially significant inasmuch as the floppy newspapers will tend to drape over such rails 78, 80 with their laterally outer margins hanging down toward the plate 76. This has the tendency of inducing a pair of transversely arcuate, structurally strengthened ridges in the lowermost paper running along the rails 78, 80 in alignment with the pushing force applied by the auxillary pushers 82 and 84. Hence, such pushing force by the pushers 82 and 84 is better resisted by the floppy newspapers, to the end that they are more readily shoved forwardly by the pushers 82, 84 while at the same time pulled forwardly by the members 100, 102 and the nip rollers 174, 176 and 170, 172.

In view of the foregoing, it should be apparent that the present invention provides in a single machine the capability of handling a wide assortment of article sizes and characteristics, from single sheet envelopes and cards, for example, to floppy, bulky, multi-page big city newspapers and the like. Moreover, the invention is able to provide reliable, trouble-free operation at speeds which enable it to serve as a means of feeding other high-speed equipment such as label applying machines and the like.

I claim:

1. In a method of handling a normally flat, multi-section, floppy newspaper having a plurality of separate inner sections received within a generally transversely U-shaped outer section provided with a pair of opposite edge extremities, the steps of:

bending the newspaper, including the outer section and its inner, contained sections, slightly to form at least one elongated ridge therein which extends from one of said extremities to the opposite extremity thereof, said bending step including supporting substantially all of the weight of the newspaper in the area of the ridge while leaving lateral edges of the newspaper substantially unsupported; and subsequently feeding the newspaper in the longitudinal direction of said ridge while maintaining the ridge therein.

2. In a method of handling a newspaper as claimed in claim 1, wherein the newspaper is fed with said fold line leading.

3. In a method of handling a newspaper as claimed in claim 1, wherein said bending step includes engaging the newspaper from beneath the same with a raised support extending generally along the ridge.

4. In a method of handling a newspaper as claimed in claim 1, wherein said bending step includes engaging the newspaper from beneath the same with a pair of elongated, laterally spaced supports to form a pair of ridges, and pressing downwardly against the newspaper from above the same with a member disposed between the two supports whereby to heighten the ridges.

5. In a method of handling a newspaper as claimed in claim 1, wherein said feeding step includes pushing against the trailing edge of the newspaper at a location aligned with said ridge.

6. In a method of handling a newspaper as claimed in claim 5, wherein said feeding step further includes gripping the newspaper between driven rollers and pulling the same in the feeding direction.

7. In a method of handling a newspaper as claimed in claim 1, wherein said feeding step includes engaging the newspaper from beneath the same with means moving in the direction of feed.

8. In a method of handling a newspaper as claimed in claim 7, wherein said means moving in the direction of feed comprises raised support means engaging the newspaper generally along the ridge.

9. In a method of handling a newspaper as claimed in claim 1, wherein the newspaper comprises the lowermost newspaper in a stack thereof, said bending and feeding steps being carried out as the newspaper is withdrawn from the stack.

10. In mechanism for handling a normally flat, multi-section, floppy newspaper having a plurality of separate inner sections received within a generally transversely U-shaped outer section provided with a pair of opposite edge extremities, the improvement comprising:

means for bending the newspaper, including the outer section and its inner, contained sections, slightly to form at least one elongated ridge therein which extends from one of said extremities to the opposite extremity thereof, said bending means being operable to support substantially all of the weight of the newspaper in the area of the ridge while leaving lateral edges of the newspaper substantially unsupported; and means for feeding the newspaper in the longitudinal direction of said ridge after formation thereof and while maintaining the ridge in the newspaper.

11. In mechanism as claimed in claim 10, wherein said bending means inoludes raised support structure disposed for engaging the newspaper from beneath the same generally along the ridge.

12. In mechanism as claimed in claim 11, wherein said raised support structure is operable to move the engaged newspaper in the feeding direction.

13. In mechanism as claimed in claim 12, wherein said raised support structure is coupled with apparatus for moving the support structure in the feeding direction.

14. In mechanism as claimed in claim 10, wherein said bending means includes a pair of elongated, laterally spaced, raised supports disposed for engaging the newspaper from beneath the same for forming a pair of said ridges, and a member disposed for pressing downwardly against the newspaper from above the same and between the two supports whereby to heighten the ridges.

15. In mechanism as claimed in claim 10, wherein said feeding means includes a pusher disposed to feed the newspaper by pushing against the trailing edge of the newspaper at a location aligned with the ridge.

16. In mechanism as claimed in claim 15, wherein said bending means includes raised support structure disposed for engaging the newspaper from beneath the same generally along the ridge.

17. In mechanism as claimed in claim 16, wherein said raised support structure is coupled with apparatus for moving the support structure in the feeding direction.

18. In mechanism as claimed in claim 17, wherein said feeding means further includes opposed, driven rollers disposed for gripping the leading edge of the newspaper and pulling the newspaper in the feeding direction.

19. In mechanism as claimed in claim 10 wherein said mechanism further includes a hopper for holding a stack of the newspapers for successive bottom feeding thereof in a transverse feeding direction relative to the upright axis of the stack, said bending means and said feeding means including an elongated support raisable into engagement with the bottom of the lowermost newspaper in the stack and movable in the feeding direction to displace the lowermost newspaper therewith, and means adjacent the front of the hopper with respect to the feeding direction for engaging the lowermost newspaper as the latter is being displaced by the support and cooperating with the support to produce the ridge in the lowermost newspaper.

* * * * *